United States Patent [19]

Elsey

[11] Patent Number: 4,660,454

[45] Date of Patent: Apr. 28, 1987

[54] PORTABLE BANDSAW MILL

[76] Inventor: Paul Elsey, Breensands, Moon Hall Road, Pitch Hill, Ewhurst, Surrey, England

[21] Appl. No.: 596,581

[22] Filed: Apr. 5, 1984

Related U.S. Application Data

[63] Continuation-in-part of Ser. No. 395,047, Jun. 25, 1982, abandoned.

[30] Foreign Application Priority Data

Nov. 6, 1980 [GB] United Kingdom ..... 8035623
Nov. 6, 1981 [EP] European Pat. Off. ..... 81305271.9
Nov. 6, 1981 [WO] PCT Int'l Appl. ..... GB81/00236

[51] Int. Cl.[4] ..... B27B 15/02

[52] U.S. Cl. ..... 83/797; 83/574; 83/661; 83/813; 83/824

[58] Field of Search ..... 83/574, 643, 824, 859, 83/701, 743, 745, 794, 795, 797, 801, 661, 813; 248/188.4

[56] References Cited

U.S. PATENT DOCUMENTS

| | | | |
|---|---|---|---|
| 2,722,953 | 11/1955 | Lee | 83/794 |
| 3,154,839 | 11/1964 | Kleber, Jr. et al. | 83/661 |
| 3,374,812 | 3/1968 | McManama | 83/813 |
| 3,530,908 | 9/1970 | Crow | 83/201 |
| 3,695,316 | 10/1972 | Pluckhahn | 83/743 |
| 3,954,037 | 5/1976 | Rios | 83/794 |
| 4,275,632 | 6/1981 | Ross | 83/795 |
| 4,476,940 | 10/1984 | Reichert et al. | 173/160 |

FOREIGN PATENT DOCUMENTS

| | | | |
|---|---|---|---|
| 762012 | 1/1977 | Finland . | |
| 20134 | of 1914 | United Kingdom | 83/813 |

*Primary Examiner*—Frank T. Yost
*Assistant Examiner*—Hien H. Phan
*Attorney, Agent, or Firm*—Young & Thompson

[57] ABSTRACT

A portable bandsaw mill, readily made sufficiently light in weight to be carried by two people, having a saw unit supported on rollers, so that the saw unit can be readily guided and the cut controlled and adjusted manually. A ground-supported support frame or unit provides guide tracks spaced apart on opposite sides of a log or other workpiece, on which the saw unit can be rollingly advanced. The ends of the guide tracks are supported in end frames by structure enabling the levels of the guide tracks to be conveniently adjusted for successively lower passes of the saw unit through the log. Guide beam ends are capable of independent adjustment to accommodate differences in level between the four corners of the support unit. A manually advanced rolling saw head of the saw unit includes two bandsaw pulleys, each having a bandsaw blade entrained thereon, one being an idler pulley and the other a drive pulley. The drive pulley, rotatably driven, can be powered by a hydraulic motor, with the actual pressure fluid source separate from the mill. The motor can be readily separable from the saw unit for use in powering other apparatus. The mill can be readily employed for rip sawing logs into boards at any convenient location for example the felling site.

18 Claims, 12 Drawing Figures

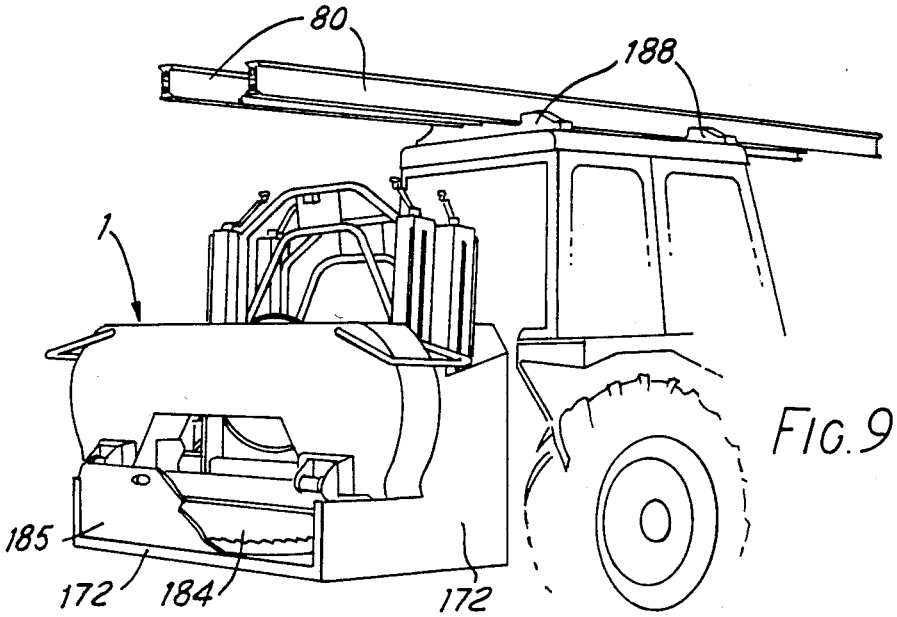
FIG. 9
FIG. 10
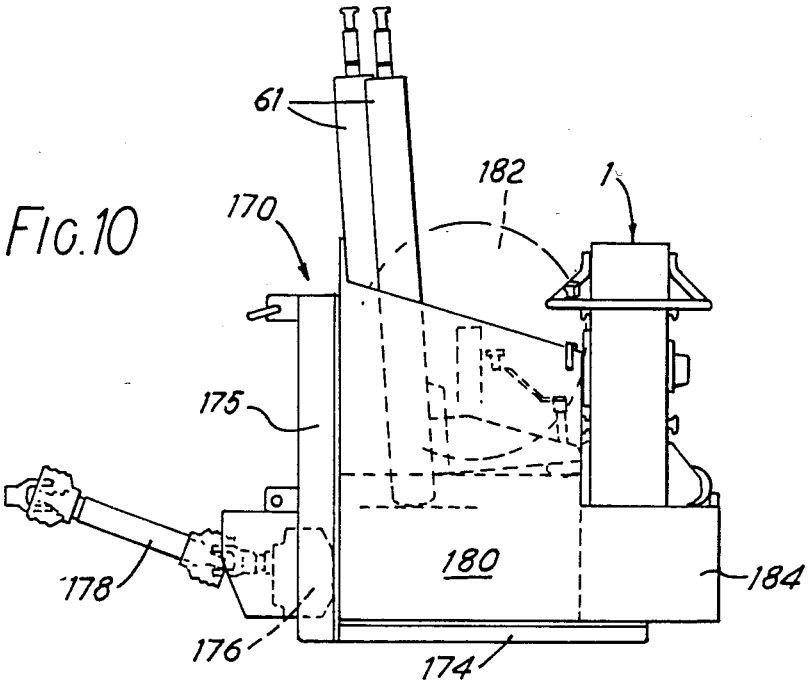

PORTABLE BANDSAW MILL

This application is a continuation-in-part of my application Ser. No. 395,047 filed June 25, 1982 now abandoned.

BACKGROUND OF THE INVENTION

The invention relates to a portable bandsaw mill, which can conveniently be operated on logs at a felling site.

A so-called portable saw mill is disclosed in U.S. Pat. No. 1,238,436 issued on Aug. 28, 1917 to R. P. Reece. The Reece saw mill is however a complex and massive structure adapted to be transported by a team of horses, and designed so that the ground supported frame, on which a carriage for the saw travels, cannot be located so as to straddle a felled tree trunk.

A more compact and portable bandsaw mill is disclosed in U.S. Pat. No. 3,721,146 issued to Charles E. MacNamana on Mar. 20, 1973. A base with clamping means for engaging a log to be sawn supports by means of U-shaped cross bars a pair of rails on which a horizontal bandsaw travels. A crank screw connection between the rails and the base permits the level of the rails to be adjusted. The base must be located beneath the log, or the log moved on to the base, and no adjustment to take into account uneven ground surfaces is provided. Moreover, the bandsaw moves on the rails by way of guides which would be liable to jamming.

A different approach is disclosed in Patent Application GB No. 2 009 037 A by A. J. Dunstan. Here, a horizontal bandhead is supported by a wheeled trolley rolling on the block to be sawn. A constant force mechanism urges the bandhead upwardly on the trolley to counterbalance its weight. Such a saw mill is necessarily of considerable weight and must be lifted by its operators between each cut.

It is an object of the invention to provide a portable bandsaw mill which is in a form to facilitate transportation to the site at which it is to be used.

It is also an object of the invention to provide a portable bandsaw mill which can be readily assembled for use and which allows accurate sawing operations to be conveniently and reliably performed.

It is a further object of the invention to provide a portable bandsaw mill in which the weight of the saw unit is supported from the ground and in which the sawing operation remains fully under operator control.

It is a further object of the invention to provide a portable bandsaw mill including a support unit for the saw unit which can be readily adjusted to accommodate irregularities of the ground surface at the site.

It is additionally an object of the invention to provide supporting guide means for a traversing saw unit in a portable bandsaw mill which enable the level of the cut to be readily adjusted.

It is a further object of the invention to provide a portable bandsaw mill in which operators can readily feed the saw unit through a log to be planked whilst retaining complete control to accommodate for irregularities in the log.

It is a further object of the invention to provide a bandsaw mill having a simple and effective saw blade tensioning device.

It is additionally an object of the invention of the invention to provide a bandsaw mill having means for facilitating replacement of the saw blade.

It is a further object of the present invention to provide a bandsaw mill comprising components which can be readily disassembled for transportation and readily assembled in working relationship to felled timber.

It is a further object of the invention to provide a portable bandsaw mill in which a manually movable saw unit is supported in a manner permitting safe operation and efficient cutting of the work.

SUMMARY OF THE INVENTION

In accordance with the invention there is provided a portable bandsaw mill having a saw unit supported on rollers, so that the saw unit can be readily guided and the cut controlled and adjusted manually.

In one embodiment of the invention, the portable bandsaw mill includes a ground-supported support frame or unit providing guide tracks spaced apart on opposite sides of a log or other workpiece and on which the saw unit can be rollingly advanced. The ends of the guide tracks are supported in end frames by means enabling the levels of the guide tracks to be conveniently adjusted for successively lower passes of the saw unit through the log. The support unit is ground-supported and the guide beams ends are capable of independent adjustment to accommodate differences in level between the four corners of the support unit.

A bandsaw mill according to the invention can be readily made sufficiently light in weight to be carried by two people. The driven pulley can be powered by an hydraulic motor, with the actual pressure fluid source separate from the mill. The motor can be readily separable from the saw unit for use in powering other apparatus. The mill can be readily employed for rip sawing logs into boards at any convenient location for example the felling site. Sawing is efficient because the saw blade produces only a narrow kerf and convenient because the blade can be manually fed through the log with the frame guided by two operators, one at each side of the log. The guide support for the frame is easily erected on site around a log to be sawn and then dismantled for use on another elsewhere. The boards or planks obtained, unlike the felled log, can be readily removed from the site without the use of heavy tackle.

The invention thus provides all the capabilities of a static saw mill, in portable form.

BRIEF DESCRIPTION OF THE FIGURES OF THE DRAWINGS

FIG. 9 is a partial perspective view of the bandsaw mill of FIG. 3 loaded on a tractor-mounted transporter device for transport;

FIG. 10 is a side view of the transporter device;

The same reference numerals are used throughout the Figures to indicate like parts.

Figure 1:
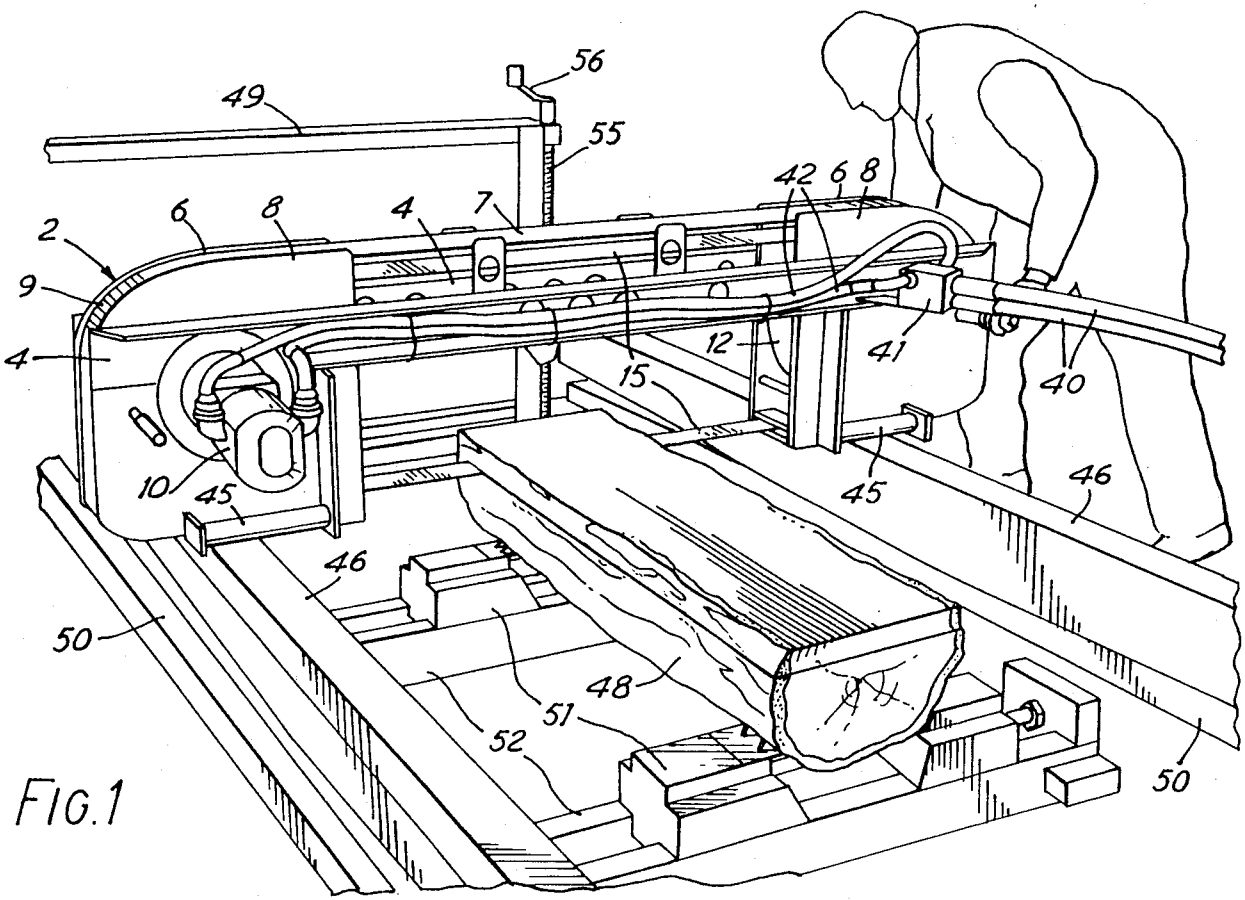
FIG. 1 is a perspective rear view of a first portable bandsaw mill embodying the invention.

The bandsaw mill illustrated in FIG. 1 is a portable, horizontally cutting, bandsaw mill comprising a saw unit 1 having a frame 2 including a pair of channel-shaped beams 4 of lightweight metal or other material connected together at their ends in spaced back-to-back relationship. Pulley housings between the ends of the two beams 4 comprise spaced parallel front and rear walls 6,8 of substantial thickness and curved side plates 9, which can be of lighter material, received in slots in the edges of the walls 6,8. A planar guard plate 7 extends between the side plates 9 and is carried by supports extending upwardly from the beams 4.

On the left-hand side of the bandsaw as shown, the rear housing wall 8 mounts a hydraulic motor 10, the drive shaft of which is connected by means of a flexible coupling to a shaft journalled by the walls 6,8 and carrying a drive pulley received between the walls. At the other side of the bandsaw, the two walls 6,8 again journal between them an idler pulley 12 rotatably mounted on a shaft non-rotatably carried by the walls. A flexible-steel saw blade 15 is entrained on the two pulleys. Each pulley may typically have a diameter of about 45 cms, and the blade length may be about 430 cms. to give an exposed cutting span of some 90 cms. The blade width can be say 10.5 cms., the tooth structure projecting by about 1 cm. beyond the pulleys. The blade 15 may have the saw tooth integrally formed with the material of the blade but preferably the body of the blade is a relatively flexible steel strip carrying a tooth structure of harder metal, the gullets between the teeth being provided by the steel strip. This facilitates reception of the blade on the rather small diameter pulleys.

The shaft mounting the idler pulley is adjustably carried by the walls 6,8 so that the saw blade 15 can be tensioned, and its tracking adjusted. The ends of the shaft thus extend outwardly through slots in the walls 6,8 and can be moved independently towards and away from the pulley 11 by a screw adjustment means located on each wall. The distance between the axes of the two pulleys can thus be adjusted and because the screw adjustment means can be operated independently, the angle between the pulley axes can be adjusted also.

The walls 6,8 also carry guide means for the saw blade 15, in the form of upper and lower wear pads engaging with the saw band surfaces, and rolling ball elements bearing on the rear edge of the blade to resist the forces experienced by the blade as it is moved through the timber being sawn. Scrapers are provided for removing deposits from the pulley drive surfaces.

A handle 22 projects outwardly from each of the walls 6,8, so that the bandsaw can be conveniently transported and operated manually by two operators.

Hydraulic fluid for driving the motor 10 is supplied, by way of power and return lines 40, from a vehicle or trailer mounted source comprising a pump driven by a diesel engine which can be controlled from the saw mill. The hydraulic lines 40 connect into a by-pass valve unit 41 carried by the frame, from which further hydraulic power and return lines 42 extend to the hydraulic motor 10. When the diesel engine is idling, the pump provides low pressure fluid and the valve unit 41 is arranged to by-pass this fluid flow to the return line, in preference to transmitting it to the hydraulic motor 10, so that the saw blade 15 is stationary. A control device located adjacent one of the handles 22 permits the operator to increase the diesel engine speed, and thus to increase the fluid pressure to a level at which the fluid supplied through the pressure line 40 is not by-passed but is transmitted to the hydraulic motor 10 to drive the blade 15.

For safety, provision may be made for operation of the hydraulic motor 10 from either side of the frame, so that either operator can stop the movement of the saw blade.

Each of the four housing walls 6,8 has externally projecting flanges between which a roller 45 is journalled for rotation about an axis parallel to the saw blade movement. The rollers 45 extend below the lower edges of the housing walls, for rolling on a pair of parallel guide tracks on opposed sides of a log 48 to be sawn. The guide tracks form part of a support unit and are constituted by the upper surfaces of a pair of parallel guide means 46, for example metal I-section beams, forming part of a cradle which has been constructed around the log. The guide beams 46 extend between rectangular upright end frames 49 which are ground-supported and connected together by ground-supported beams 50 beneath the guide beams 46. The log 48 is held in place by clamps 51 adjustable along transverse members 52.

In the position shown in FIG. 1, the saw mill is near to the end of a cutting stroke effected by manual movement of the frame with the rollers 45 rolling on the guide track beams 46. The level of the exposed lower run of the saw blade 15 relative to the log 48 must be lowered for the next cut, and the beams 46 are connected to the end frames 49 so as to permit this adjustment. The beams 46 are mounted at their ends to the end frames 49 by means of internally threaded bushes received on vertically guided threaded shafts 55. The shafts 55 are rotatable by means of handles 56 at their upper ends. The end frames 49 carry fixed scales at each corner so that the level of thc beams can be selectively adjusted by known amounts after each cut.

In an alternative arrangement, the beams 46 are fixed in position and the level of the saw blade 15 is adjusted by vertical adjustment of the rollers 45 on the housing walls 6,8. Instead of the hydraulic motor, an electric motor, a compressed air motor, or a lightweight internal combustion engine could be employed to drive the saw blade.

Figure 2:
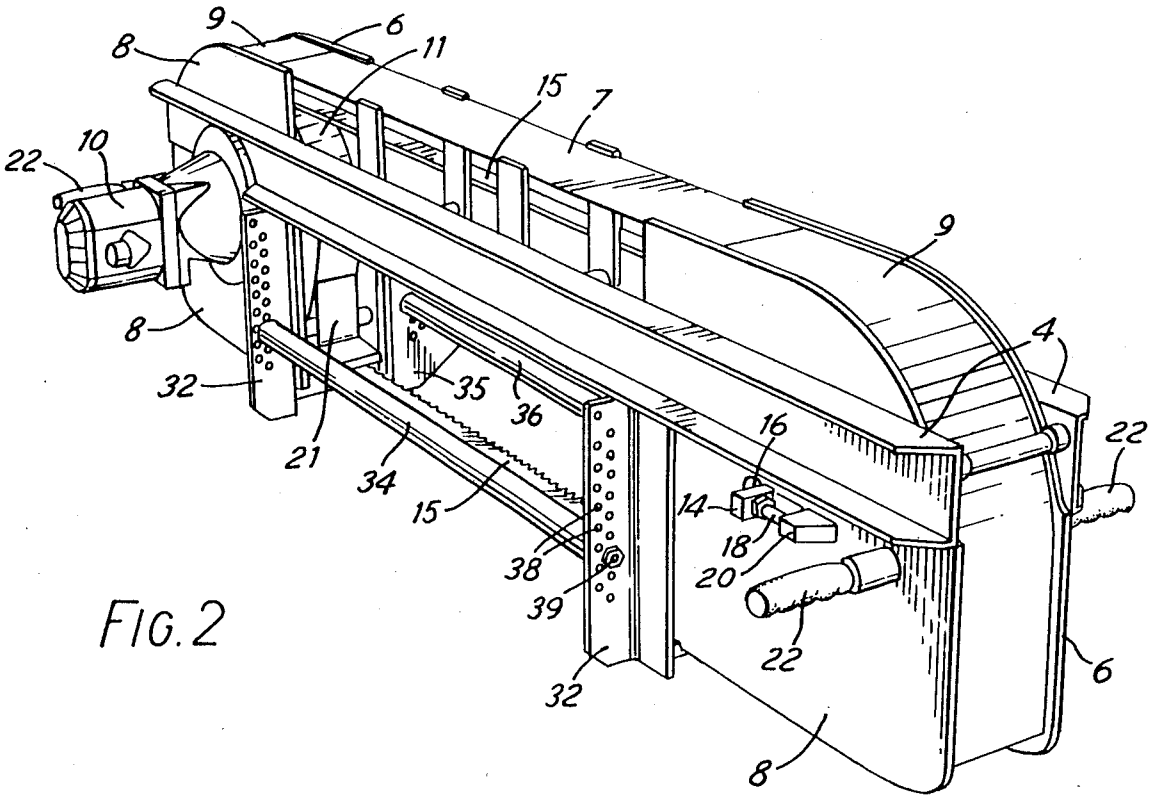
FIG. 2 is a perspective rear view of a bandsaw mill having a modified form of guide support means.
Figure 3:
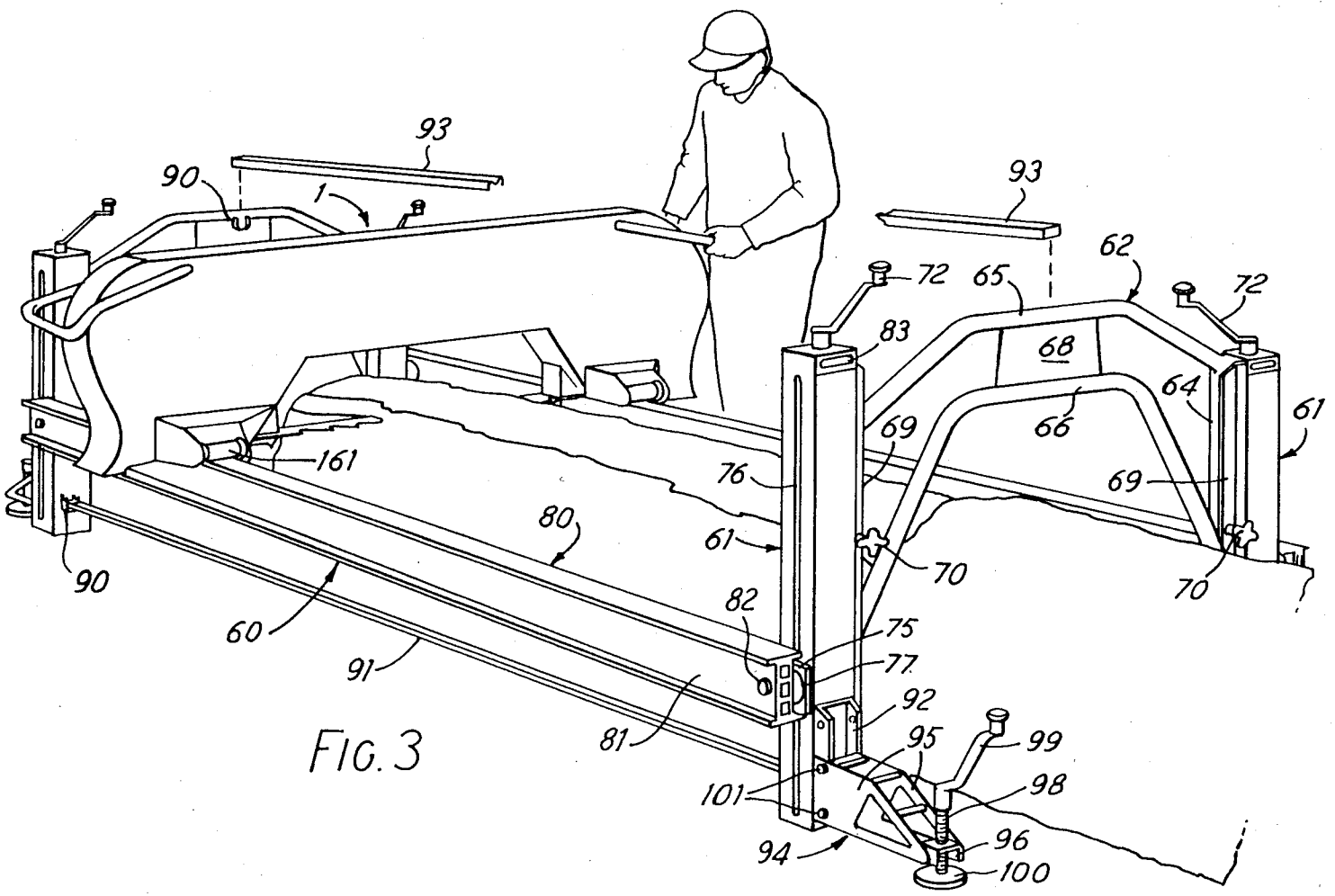
FIG. 3 is a perspective view of a third portable bandsaw mill embodying the invention, with saw unit details omitted.

In the modified guide arrangements of FIG. 2, the rear walls 8 carry at their inner edges rearwardly projecting flanges 32 between which a guide roller 34 is journalled. Similar flanges 35 project forwardly from the inner edges of the two front walls 6 and two leading guide rollers, of which only roller 36 is shown, are journalled between these flanges. The vertical spacing between the lower horizontal run of the band 15 and the rollers 34,36 determines the thickness of the saw cut and to render this adjustable, the height of the axes of the rollers is adjustable. As shown, this is done by providing in the flanges 32,35 a series of vertically spaced holes 38, in which stub shafts 39 for the rollers can be replaceably received. The vertical spacing of the holes 38 determines the possible incremental adjustment of the cutting thickness.

Support for making a first cut on a log can be provided by fixing a portable rail or plank to the top surface of the log. After a first cut made in this way, the bandsaw cutting position is located by the rollers 34,36 relative to the top surface exposed by the previous cut.

The portable bandsaw mill embodying the invention illustrated in FIGS. 3–11 includes a support unit 60 having at each end two spaced legs 61 or corner posts having a metal end frame 62 extending between them. Each of the end frames 62 comprises two square-sectioned uprights 64 joined together by upper and lower upwardly arched cross-pieces 65,66, of which the lower cross-piece 66 is more extremely arched so as to approach towards the upper cross-piece 65 at its centre, where the two cross-pieces are secured together by a plate 68. Each end frame 62 has an unobstructed lower region and can span across a log which extends well above the join of the lower cross-piece 66 to the uprights 64.

Each of the four legs 61 is of hollow construction being made up from four rectangular metal side plates, and square end plates. The opposed side faces of the two legs 61 at each end of the unit 60 are provided with spaced elongate flanges 69 extending longitudinally, between which an end frame upright 64 can be received. A screw clamp member 70 extending through holes in the flanges 69 outwardly of the upright 64 can be operated manually to urge the two flanges together so as to clamp the upright between them. As will be seen from FIG. 3, the upright 64 can be clamped between the flanges 69 at any one of a range of relative longitudinal positions. The end frame 62 can thus be rigidly assembled between an opposed pair of legs 61 of which the lower ends engage the ground at different levels.

A threaded shaft 71 is journalled in the end plates to extend along the longitudinal axis of each leg 61 and can be rotated manually, through a clutch, by a hand1e 72 secured to the upper end of the shaft which projects through the upper end of the shaft which projects through the upper end plate. A nut 72 received on the shaft 71 is fixed to an arm extending inwardly from an inner plate 73 from which a shaft 76 extends outwardly of the leg 61 through a longitudinal slot formed in the leg side wall opposite that provided with the flanges 69. Low friction pads 74 for example of a plastics material, for example that sold under the trade name Perplas, are provided between the plate 73 and this leg side, and between this wall and an outer plate 75 externally of the leg 61, the plates being clamped together by means of the shaft 76. A fitting 77 secured to the plate 75 mounts an outwardly projecting spigot 82.

The spigot 82 provides a means for supporting one end of a guide beam 80, which has the form of an aluminium extrusion of generally I-shaped cross-section. The centre web 81 of the beam 80 is hollow and reinforced by two equi-spaced cross webs so as to combine light weight with rigidity. At each end, the centre web 81 is apertured for reception of the spigot 82 which is apertured for reception of a lynch pin to releasably hold the beam on the spigot. A resettable counter device with a display portion 83 is driven by the shaft 71 so as to be able to indicate changes in the vertical position of the plate 74 and thus of the end of the beam 80 secured thereto.

Toward the lower end of each leg 61, a bracket 90 is secured to a side face between the slotted and flanged side faces for connection of one end of a stringer 91 which serves to releasably connect together the two legs 61 at one side of the log. The stringer end and the bracket 90 are adapted to be releasably clipped together. Brackets 9 are provided also at the centre of the upper cross-piece 65 of each end frame 62, for similar releasable reception of a third or top stringer 93.

Towards the lower part of the leg side face opposed to that carrying the brackets 90, a longitudinally extending channel member 92 is fixed to the leg. The channel member 92 serves to mount an extension leg 94 comprising two side plates 95 connected together in spaced relationship and having at the end remote from the leg a tapped fitting 96 for receiving a threaded shaft 98 having a handle 99 at its upper end by which it can be rotated to adjust the level relative to the extension leg of a foot member 100 rotatably carried at the other end of the threaded shaft. The foot member 100 can be a disc of relatively large area for engagement with soft ground, or can be spiked or otherwise shaped at its undersurface for secure engagement with a surface on which the support unit 60 rests. At their inner ends, the plates 95 of the extension leg 94 overlap the outer sides of the side webs of the channel member 92, to which the extension leg is secured by pins 101 extending through first and second sets of aligned holes in the extension leg side plates and the channel member side webs. The channel member side webs can be provided with additional holes, so that the height of the extension leg 94 relative to the lower end of the associated leg 61 can be selectively adjusted, by removal of the pins and replacement through different holes.

The support unit 60 is set up in appropriate relationship to a log or other cross-piece to be sawn by first positioning the extension legs 94 of each leg 61 so that the legs stand upright at approximately the required positions without further support. The uprights 64 of the end frames 62 are placed between the flanges 69 and clamped in place to secure the end frames to the pairs of legs 61. The two lower stringers 91 and the top stringer 93 are then fitted. The end frames 62 are kept as high as is reasonably possible.

The guide beams 80 are then secured on the spigots 82 and after any necessary final adjustment, the positions of the ends of the guide beams are adjusted by turning the handles 72 so that the guide beams are parallel, and preferably as nearly as possible horizontal. The support unit is then ready to receive the saw unit 1 and the top stringer 93 is removed to facilitate placing of the saw unit on the guide beams which will normally now be at an upper position initially. The top stringer 93 serves only to oppose any tendency of the legs and end frames to collapse inwardly towards each other when the guide beams 80 have been moved downwardly towards the lower ends of the legs 61, and it need not be replaced until this position is reached, when the top stringer will clear the top of the saw unit.

Figure 6:
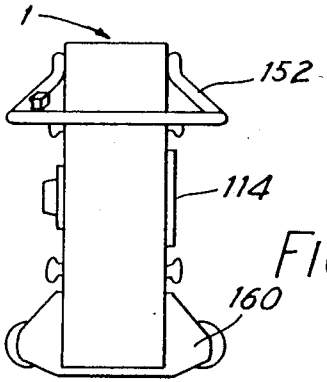
FIGS. 5 and 6 are front and side views respectively of the saw unit of the bandsaw mill of FIG. 3.
Figure 4:
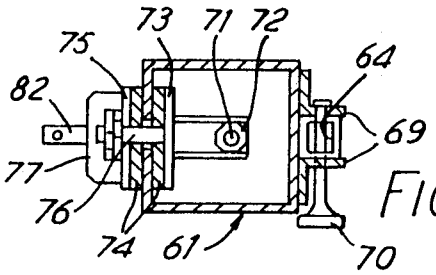
FIG. 4 is a cross-section in plan of one leg or corner post of the support unit of the bandsaw mill of FIG. 3.
Figure 5:
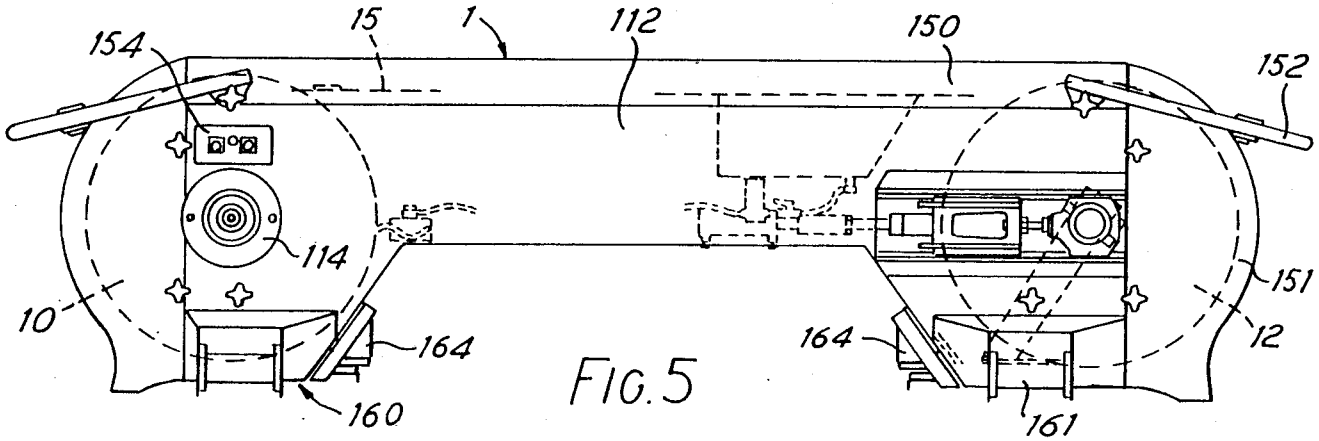
Figure 7:
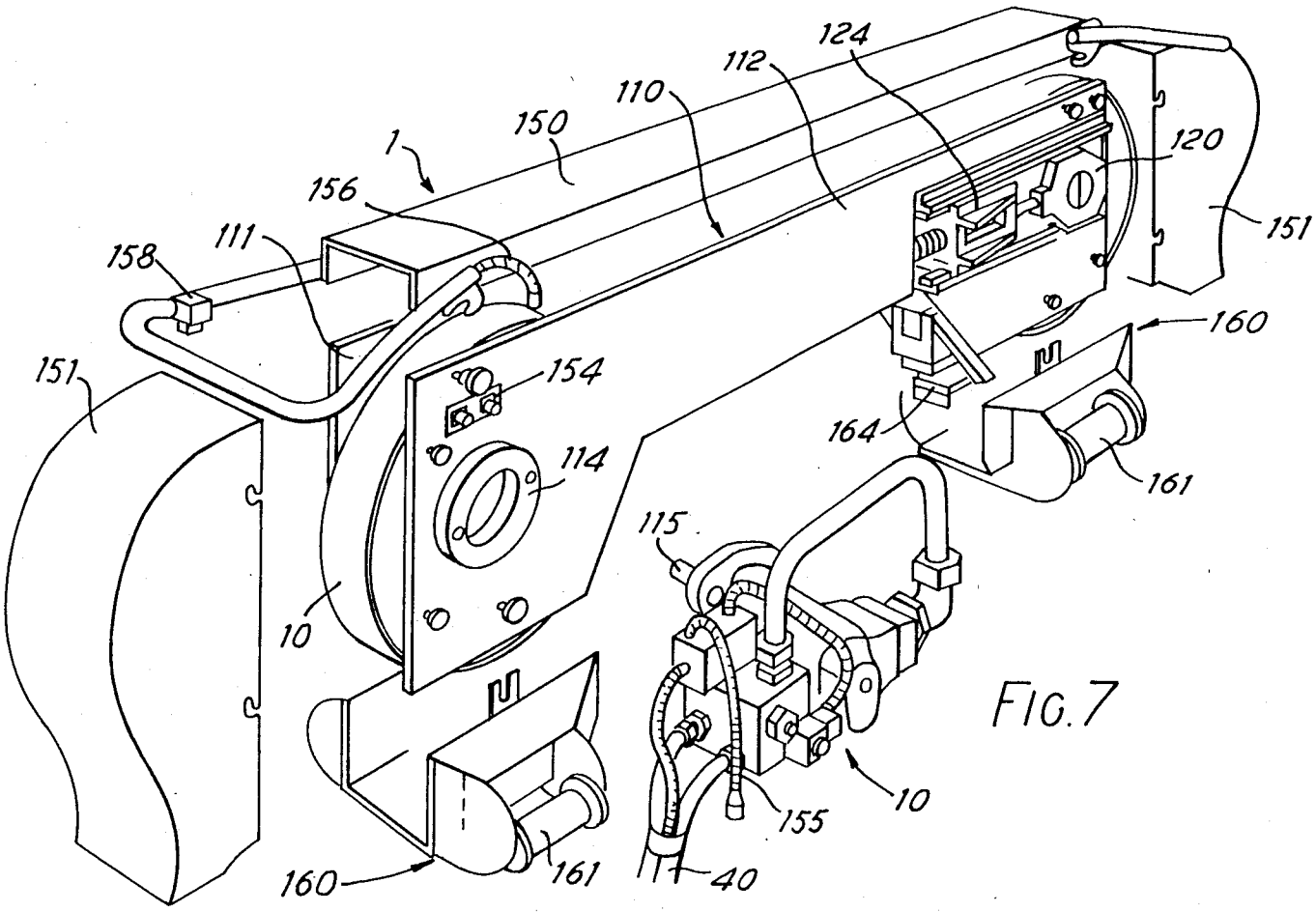
FIG. 7 is a perspective view of the saw unit of the bandsaw mill of FIG. 3, with parts thereof shown disassembled.

The saw unit 1 as best appears from FIGS. 5–7 comprises a frame 110 consisting of two side plates 111 and 112 secured together in parallel spaced relationship and journalling between them the drive pulley 10 and the idler pulley 12 for the saw blade 15. At the outer side of the side plate 112 a motor mounting ring 114 is provided by which the hydraulic motor 10 can be attached to the frame by a pair of bolts extending through a motor mounting plate into tapped holes in the mounting ring. The hydraulic motor 10 has a splined drive shaft 115 by which it makes driving engagement with the hub of the pulley 10, which is journalled in the frame for rotation on a fixed axis. The idler pulley 12 is mounted by means of an adjustable band straining or tensioning device, shown in FIG. 8, which permits selective adjustment of the spacing of the idler pulley axis from that of the drive pulley, as well as angular adjustment of the axis. The device applies spring tension to the saw blade 15, and allows for quick replacement of a bandsaw when required.

The side plates 111,112 are generally rectangular except for a large central recess opening inwards from the lower edge to expose the lower run of the blade 15. A channel shaped top guard 150 and two end guards 151 shaped to accommodate the pulleys 10,12, which project outwardly beyond the side plates 111,112 are secured to the side plates by bolts extending into tapped holes in the side plates, through recesses at the edges of the top and end guards. The clamping bolts which secure the top guard 150 to the side plates secure also generally U-shaped handles 152, one at each end of the saw unit. The handles 152 include plates fixed to the ends of the limbs of the handles, with hook-shaped recesses for receiving the clamping bolts so that the saw unit can still be lifted by way of the handles, even if the bolts are not fully tightened.

The saw unit 1 includes a first scraper positioned to operate on the blade 15 as it leaves the drive pulley 10 and a second scraper carried by an arm movable with the idler pulley 12 to act on the blade as it leaves that pulley. The frame 110 carries guide blocks 164 between which the exposed lower run of the saw blade extends and these are lubricated by a drip feed arrangement from liquid lubrication held in a tank between the side plates. Lubricant is also fed through a solenoid operated valve, which opens when the motor 10 is switched on, to supply lubricant to reservoirs from which extend felt pads engaging the running surface of each pulley.

Just above the mounting ring 114, side plate 112 mounts sockets 154 for connection of a plug at the end of an electric cable 155 extending from the motor 10 and a plug at the end of a cable 156 extending through the adjacent handle 152 from a control switch 158 provided thereon and from a like control switch provided on the handle 152 at the other end of the saw unit by way of the top guard 150.

Figure 8:
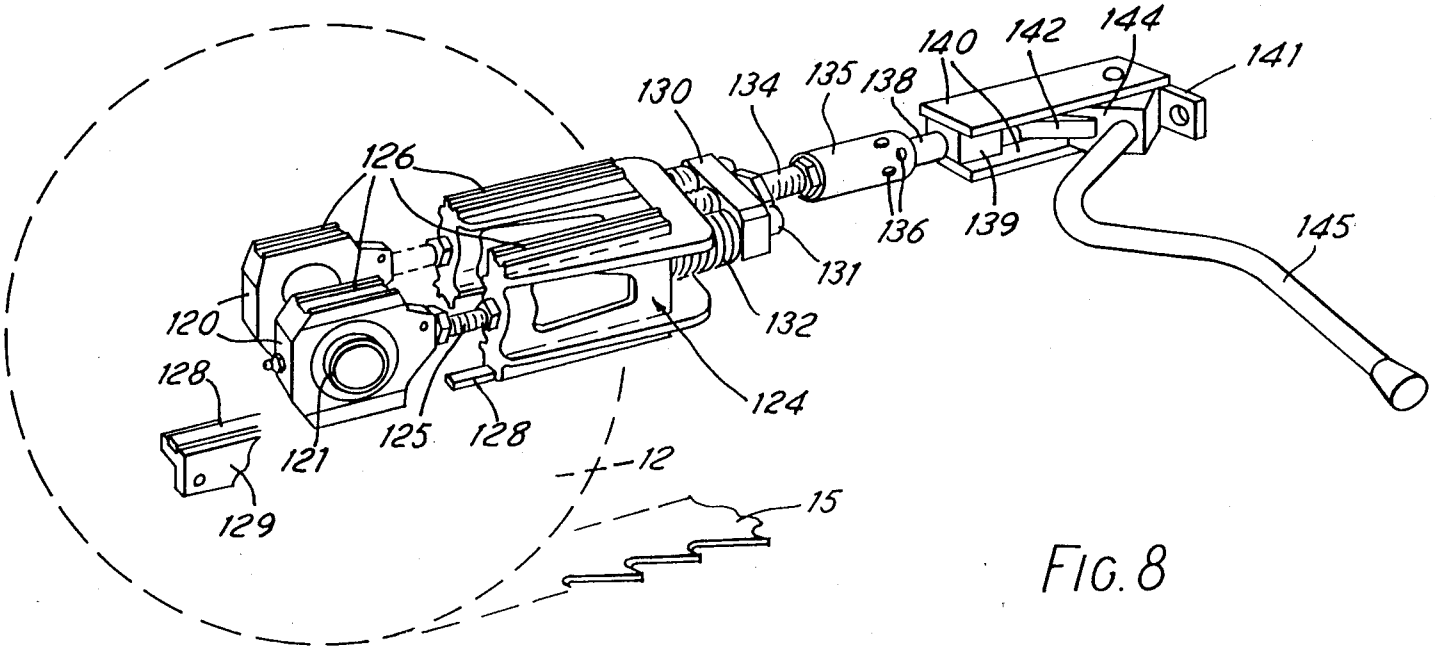
FIG. 8 is a perspective view on a larger scale of bandsaw tensioning device included in the saw unit of the bandsaw mill of FIG. 3.

A cover (not shown) normally covers an aperture in the side plate 112 allowing access to the blade tensioning device of FIG. 8, and the saw unit is completed by a pair of detachable roller carriages 160 which are removably bolted to the ends of the lower edges of the frame 110. Each carriage 160 comprises a channel member of which the side walls overlap the plates 111,112, each carrying externally a mounting for a roller 161. The carriages are precision fitted to the frame to ensure that the axes on which the four rollers 161 rotate extend in a common plane.

The rollers 161 have an axial extent which is greater than the width of the tracking surfaces provided by the guide beams 80 so the saw unit need not extend strictly at right angles to them. High accuracy of cutting is required to produce commercially acceptable timber, and any slight irregularity in cut increases friction and leads to "snaking" of the blade, that is, departure from the desired cutting plane, with loss of cutting power due to greater effective resistance to cutting. The saw unit of the invention provides easy accurate cutting because it is advanced on the rollers 161 with minimal support friction under direct manual control. Moreover, as the saw unit can be slightly slewed on the guide beams, the operators can react immediately to compensate for cutting irregularities, which arise quite frequently because of irregularities in the texture of the timber being cut. Also, they can prevent "tailing" that is blade distortion due to impact with the entire width of the wood to be cut at the beginning of a sawing pass by corner entry.

As best appears from FIG. 8, the pulley 12 is received between two bearing blocks 120 and runs on a shaft extending to both sides of the pulley into self-aligning bearings 121 in the bearing blocks. Each block 120 is separately connected to the free end of a respective limb of a yoke member 124 by means of a threaded shaft 125 received in tapped recesses in the opposed limb and bearing block ends. Lock nuts on each shaft 125 engage the bearing block and the yoke member limb to maintain a selected spacing of the bearing 121 from the yoke member. The upper and lower surfaces of each bearing block 120 and of each limb of the yoke member 124 are provided with aligned shallow rectangular grooves 126 by which the yoke member and bearing block are slidably guided for movement towards and away from the driven pulley on runners 128 secured to the frame side plates. The four runners 128 conveniently comprise bars of rectangular cross-section of a suitable low friction plastics material, for example that sold under the trade name Perplas. Each runner 128 is carried by a metal support bar 129 secured to the appropriate frame side plate and shaped to provide a rectangular groove in which the runner is received.

The yoke member 124 has a centre portion remote from the bearing blocks 120 connected to a cross bar 130 by a pair of laterally spaced bolts 131, the screw threaded ends of which are received in tapped holes in the centre portion. On the bolts 131, between the centre portion and the cross bar are received a plurality of Belleville or circular spring washers 132. The cross bar 130 has a centrally located tapped hole which receives one end of a threaded shaft 134 of which the other end is received in the tapped end of an adjustment sleeve 135. Lock nuts on the shaft 134 engage the cross bar and the sleeve end to secure a selective spacing between these parts, obtained by relatively rotating them on the shaft. The s1eeve 135 is provided with radial holes 136 intermediate its ends to receive a tool to facilitate rotation to effect this adjustment. The other end of the sleeve 134 is rotatably received on the end of a shaft 138 for rotation without substantial axial movement, as by reception of an internally protecting flange at the end of the sleeve in a groove formed around the end of the shaft.

The shaft 138 is guided for longitudinal sliding movement in an aperture in a block 139 fixedly received between two spaced horizontal rectangular plates 140. At their ends remote from the block 139, the plates 140 are fixedly secured to a bulkhead of the frame 110 extending transversely between the two side plates 111,112 by means of bolts received through holes in an upright end plate 141 secured between the plates 140. The end of the shaft 138 remote from the sleeve 135 is pivotably connected to one end of a flat link 142 of which the other end is pivotably connected to a generally rectangular toggle block 144 which is itself secured between the plates 140 for pivotation, about an axis parallel to the axes of pivotation of the link 142. The block 144 is provided with a aperture for reception of one end of a handle 145 member. The shaft 138, the link 142 and the block 144 together form an overcentre toggle mechanism, readily operated by movement of the handle 145 to effect substantial movement of the yoke member 124 and thus of the bearing blocks 120 and the idler pulley 12.

When it is desired to change the bandsaw blade, the saw unit 1 is turned to rest on the guide beams 80 with the side plate 112 exposed. The motor 10 is preferably removed as a safety measure. The top and end guards 150,151 are then removed from the frame and so is the cover normally enclosing the bandsaw tensioning device. The handle 145 is inserted in the toggle block 144 which is then turned by means of the handle so as to move the idler pulley 12 towards the drive pulley 10. The bandsaw 15 then fits loosely over the pulleys and can be easily removed because of the projection of the two pulleys beyond the ends of the side plates. The new bandsaw is then put into place around the pulleys and the toggle mechanism is operated in the contrary direction to tension the blade. Adjustment to accommodate differences in length between the replaced and the replacement blades is effected by releasing the lock nuts on the threaded shaft 134 and turning the sleeve 135 as required direction until an appropriate spring tension is being applied by the washers 132, as can be readily assessed by observation of the gaps between them, after which the lock nuts are again tightened into place. Any necessary angular adjustment of the axes of the two pulleys is effected by releasing the lock nuts on one or other of the screw threaded shafts 125 between the bearing blocks 120 and the yoke member 124, rotating the shafts, and then returning the lock nuts to the locking position. Differences in the effective lengths of the shafts 125 are accommodated by the self-aligning bearings 121. A certain amount of length adjustment can be effected by means of the shafts 125. The blade replacement having been made, the handle 145 is removed, and the cover plate restored to the side plate 112. After the motor 10 has been attached, the saw unit 1 can be turned back to its operative position ready for use.

Figures 11A, 11B:
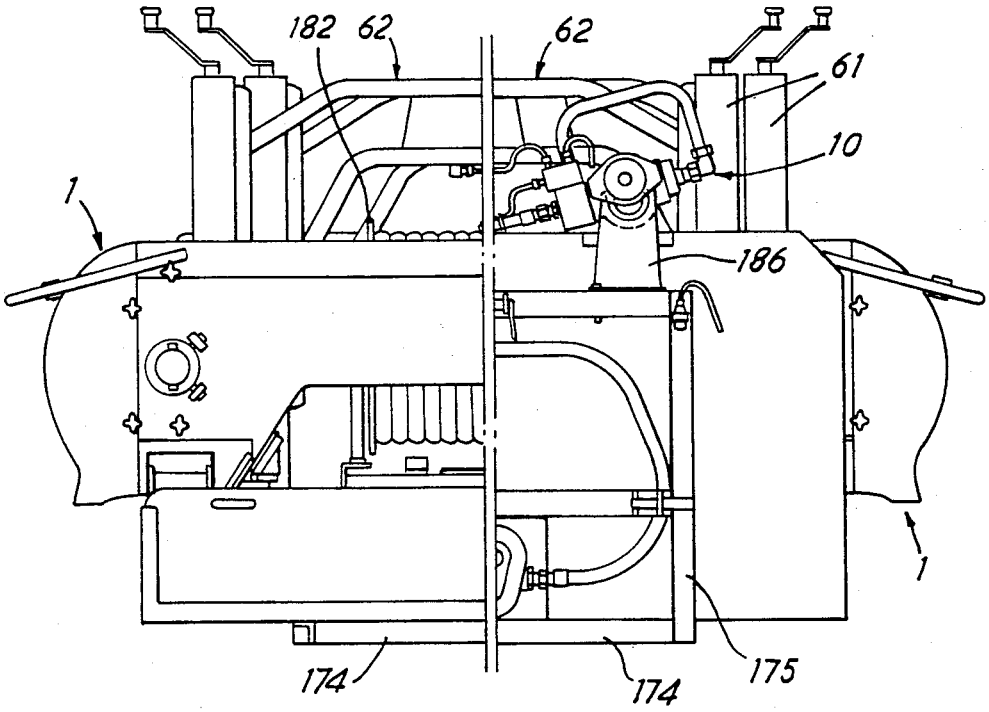
FIG. 11A is a rear view of the left-hand half of the transporter device.
FIG. 11B is a front view of the right-hand portion of the transporter device.

As shown in FIGS. 9–11, a transporter unit can be provided in accordance with the invention, whereby the portable bandsaw mill of FIGS. 3–8 can be conveniently transported to and from site by means of a tractor.

The illustrated transporter device or unit 170 comprises sheet metal front and base walls connected by side walls 172 and supported on horizontal and vertical rectangular tractor frames 174,175. Forwardly of the front wall of the unit, the vertical frame 175 mounts an hydraulic pump 176 which can be driven through the tractor power take-off connection by a shaft 178. A tank 180 for hydraulic fluid occupies the lower front region of the unit 170 and the pump output is supplied to the motor 10, in use of the mill on site, by way of the hydraulic hose or line 40, which can be withdrawn from a reel 182 mounted above the tank, centrally of the unit.

The two end frames 62 of the support unit, each with its associated legs 61, are accommodated forwardly in the unit 170, with the end frames positioned fairly high up the legs so as to straddle the reel 182. The extension legs 94 project rearwardly and the legs and frames are staggered laterally, as best appears from FIG. 10 to accommodate the extension legs.

Rearwardly of the tank 180, the transporter unit is sub-divided to form a compartment 184 for reception of saw blades, normally closed by a removable rear panel 185 which can slide upwardly for access to the interior. The saw unit 1 is located on the top of this compartment 184 and the hydraulic motor 10 is received on a motor stand 186 at the top of the tractor frame 175. The beams 80 and the three stringers 91,93 are accommodated on mounting bars 188 on the roof the cabin of the tractor.

Because of the ease with which the portable bandsaw mill of the invention can be demounted into easily handable parts, it can be readily transported by various means to and from its place of use but the transporter unit 170 provides a particularly compact and convenient arrangement for transporting the mill where it is to be used at sites accessible only by tractor, rather than by ordinary road vehicles.

It is evident that those skilled in the art may make numerous modifications of the specific embodiment described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

I claim:

1. A portable bandsaw mill comprising a saw unit and a support unit for the saw unit; said support unit comprising: two end frame means, two guide beam members, means for supporting the ends of said two guide beam members in said end frame means, said supporting means permitting selective independent adjustment in the vertical direction of each end of each of said guide beam members, so that the said guide beam members, can be made to extend substantially parallel to each other at a selected level along opposed sides of a piece of timber to be sawn; said saw unit comprising a manually advanced rolling saw head having: a saw frame, first and second bandsaw pulleys, means journalling said bandsaw pulleys on said saw frame about spaced substantially parallel axes adjacent respective ends of said saw frame with said pulleys substantially in a common plane, a bandsaw blade entrained on said bandsaw pulleys, drive means for rotatably driving said first pulley, manually engageable handle means adjacent each said end of said saw frame, and roller means located at each end of said saw frame for supporting said saw unit on said guide beam members to span across said guide beam members with said saw unit engaging said support unit only by way of said rollers.

2. The bandsaw mill of claim 1 wherein each of said supporting means permitting independent adjustment comprises internally threaded means and a rotatable threaded shaft extending through said internally threaded means.

3. The bandsaw mill of claim 1 wherein said drive means for rotatably driving said first bandsaw pulley comprises a hydraulic motor mounted on said saw frame.

4. The bandsaw mill of claim 1 wherein said second bandsaw pulley is an idler pulley journalled on said frame for adjustment in respect of at least one of its angular relationship with, and its lateral spacing from, the rotational axis of said one bandsaw pulley.

5. The bandsaw mill of claim 1 further comprising independent control means for stopping movement of said bandsaw blade at each end of said saw unit.

6. The bandsaw mill of claim 1 wherein said bandsaw blade comprises a metal saw tooth structure carried by a band of more flexible metal.

7. The bandsaw mill of claim 1 wherein each of said end frame means comprises a frame structure; spaced ground engaging elements on said frame structure and means for selective independent vertical adjustment of said spaced ground engaging elements relative to said frame structure.

8. The bandsaw mill of claim 1 wherein said roller means exceed the width of said guide beam members in axial length thereby facilitating manual section of the attitude of said bandsaw blade to the piece of timber to be sawn.

9. A portable bandsaw mill comprising a saw unit and a support unit for said saw unit; said saw unit including a bandsaw blade and means for causing movement of said blade in a predetermined direction; said support unit comprising two spaced end frames and two spaced guide beam members extending between said end frames and adapted to carry said saw unit thereon, each of said end frames comprising two upright corner posts, each corner post having a ground-engaging lower end, a frame element extending between said two corner posts, means securing said frame element to each of said two corner posts at respective selected relative positions therealong, whereby said end frame forms a rigid structure notwithstanding differences in ground level at said corner post lower ends, connection means for connection of each end of each guide beam member to a respective one of said corner post, and means for selective adjustment vertically of said connection means relative to the associated one of said corner posts independently of the vertical positions of said connection means associated with said other corner posts.

10. The bandsaw mill of claim 9 wherein said saw unit comprises roller means journalled for rotation about an axis parallel to said direction of movement of said bandsaw, said roller means being located for support of said saw unit on said guide beam members.

11. The bandsaw mill of claim 9 further comprising handles at each end of said saw unit for manual placement of said saw unit on said guide beam members and manual feeding of said saw unit along said track members.

12. The bandsaw mill of claim 9 further comprising an extension leg extending laterally from each of said corner posts, each extension leg providing a ground engaging surface spaced from said ground engaging lower end of said corner post.

13. The bandsaw mill of claim 12 further comprising means for selective adjustment of the level of each of said extension legs relative to the level of the ground engaging lower end of said associated corner post.

14. The bandsaw mill of claim 12 further comprising means for selective adjustment of the level of each of said ground engaging surfaces relative to the associated extension leg.

15. The bandsaw mill of claim 9 wherein each of of said frame elements has a recess opening from a lower edge thereof, whereby to accommodate a workpiece extending through the associated end frame.

16. The bandsaw mill of claim 9 further comprising a plurality of elongate stringer members and means on said end frames providing for releasable connection of the ends of said stringer members to said end frames, to thereby rigidify said support unit.

17. The bandsaw mill of claim 16 wherein said means for releasable connection of said stringer members are located in the lower region of each of said corner posts, and centrally of said frame elements.

18. The bandsaw mill of claim 9 wherein said saw unit comprises spaced apart side plate members, a drive pulley journalled between said side plate members, an idler pulley received between said side plate members, a bandsaw blade extending around said pulleys, means journalling said idler pulley between said side plate members and adjustment means permitting selective adjustment of the positional relationship of said idler pulley relative to said drive pulley, and an aperture in one of said side plates whereby access can be had to said adjustment means.

* * * * *